US006883577B2

(12) United States Patent
Frede

(10) Patent No.: US 6,883,577 B2
(45) Date of Patent: Apr. 26, 2005

(54) ROLLUP DOOR WITH ROLLABLE DOOR LEAF

(75) Inventor: Friedhelm Frede, Erwitte (DE)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/372,495

(22) Filed: Feb. 24, 2003

(65) Prior Publication Data

US 2004/0163777 A1 Aug. 26, 2004

(51) Int. Cl.[7] ..... E06B 9/15

(52) U.S. Cl. ..... 160/133; 242/602; 160/323.1

(58) Field of Search ..... 242/602.1, 602, 242/602.3, 613.1; 160/133, 264, 231.1, 230, 231.2, 323.1

(56) References Cited

U.S. PATENT DOCUMENTS

| | | | | | |
|---|---|---|---|---|---|
| 147,862 | A | * | 2/1874 | Reynolds | 160/133 |
| 812,722 | A | * | 2/1906 | Cahill | 160/116 |
| 2,898,988 | A | * | 8/1959 | Zoll | 160/229.1 |
| 3,361,189 | A | * | 1/1968 | Dixon et al. | 160/231.2 |
| 4,889,176 | A | | 12/1989 | Nilsson | 160/264 |
| 4,929,497 | A | | 5/1990 | Mitchell et al. | 428/265 |
| 4,930,563 | A | * | 6/1990 | Finch et al. | 160/271 |
| 5,095,965 | A | * | 3/1992 | Higashiyama | 160/133 |
| 5,307,859 | A | | 5/1994 | Kraeutler | 160/264 |
| 5,450,694 | A | * | 9/1995 | Goranson et al. | 52/71 |
| 5,484,007 | A | | 1/1996 | Rejc | 160/133 |
| 5,579,820 | A | * | 12/1996 | LePage et al. | 160/268.1 |
| 5,601,133 | A | | 2/1997 | Krupke et al. | 160/265 |
| 5,632,317 | A | | 5/1997 | Krupke et al. | 160/265 |
| 5,641,132 | A | * | 6/1997 | Bardy | 242/536 |
| 5,682,937 | A | * | 11/1997 | Decrane et al. | 160/133 |
| 5,829,504 | A | | 11/1998 | Ekstrand et al. | 160/201 |
| 6,065,525 | A | * | 5/2000 | Wells | 160/273.1 |
| 6,296,039 | B1 | * | 10/2001 | Mullet et al. | 160/267.1 |
| 6,397,916 | B1 | | 6/2002 | Bengtsson et al. | 160/84.06 |

FOREIGN PATENT DOCUMENTS

| | | |
|---|---|---|
| WO | WO 00/60208 | 10/2000 |
| WO | WO 01/69032 A1 | 9/2001 |

* cited by examiner

*Primary Examiner*—Blair M. Johnson
(74) *Attorney, Agent, or Firm*—Frommer Lawrence & Haug LLP; Ronald R. Santucci

(57) ABSTRACT

A rollup door comprising a door leaf of increasing width from top to bottom and having a narrower part on the top and a wider part on the bottom, and flexibility in the rolling direction; channels for guiding the door; and two modules for rolling and unrolling the door leaf so that a number of leaf layers do not come in contact. The modules are situated on each side of the door, have the same center axes and are successive radially enlarged so that on opening and closing of the door, the narrower and wider parts of the leaf engage the smaller and larger parts respectively of the modules.

36 Claims, 11 Drawing Sheets

FRONT VIEW

REAR VIEW

ROLLUP DOOR WITH ROLLABLE DOOR LEAF

FIELD OF THE INVENTION

The present invention relates to a rollup industrial door that can operate at high speed and low noise level. More specifically, the invention relates to a rollup door comprising a door leaf or blade of increasing width from top to bottom and having flexibility in the rolling direction, channels for guiding the door, two modules for rolling and unrolling the door leaf so that a number of leaf layers do not come in contact, wherein the modules are situated on each side of the door, have the same center axes and are successively radially enlarged so that on opening and closing of the door, the narrower and wider parts of the leaf engage the smaller and larger parts respectively of the modules.

BACKGROUND OF THE INVENTION

Since the 1970's there has been a great need to use rapidly moving doors in buildings for industrial use. This applies to openings indoors as well as in external walls, where the door provides shielding between different activities or prevents drafts and heat losses. Presently, rolling doors with flexible door leaves are used for this purpose, but also more rigid constructions like slatted doors with polymeric or metallic lamellae are used. These doors are rolled up on an overhead drive cylinder and can be provided with additional elements like a weight balance system, tensioning system, windows or the like. For safety reasons, rolling doors can be provided with safety edge protection, failsafe devices, drop protection, etc.

As understood from the above, rollup doors are available in different styles and materials. In one traditional design the door leaf is rolled up on a shaft directly upon itself. The drawback with this construction for more rigid doors is that wear soon causes visible marks on the lamella surface, which is regarded as a negative factor. In addition the lamellae are rolled on each other without any padding, which causes noise. These doors are normally run at low opening and closing speed in order to overcome this.

A flexible door leaf with, for example, sensitive material such as PVC, can also suffer from these wear problems. U.S. Pat. No. 5,307,859 discloses that this can be overcome by applying additional flexible strips extending perpendicular to the driving shaft. When the curtain is rolled or folded in its retracted position, the separation strip rolls or folds on itself to hold the layers of the curtain apart from one another.

U.S. Pat. No. 5,484,007 describes a slatted door comprising two guide tracks situated on opposite sides of the door opening. The guide tracks extend vertically over approximately the height of the door opening, and then merge at the entrance of the door into an inwardly positional spiral, so that the slats of the door run essentially free of each other, thereby providing a high speed door. This design requires guiding channels approximately twice as long as the door height. The lamellae, rolls, and guiding system are in motion during the complete opening/closure operation, which causes increased wear and noise.

A related door construction is disclosed in WO 01/69032 which overcomes the above-described disadvantages by providing a chain of support bodies screwed onto the side of the lamellae. These links are thicker than the lamellae. During the roll up operation, these support bodies roll upon each other and create a distance between the lamellae. In order to create an even roll, the links are curved according to an average roll up diameter. Still, this door design has a disadvantage in that the rolled up layers are in direct contact with each other, which causes noise. Also, an increased diameter is necessitated. The support bodies are rolled upon each other on an irregular surface, which is only partly compensated by the arched geometry. This top-on-top rolling leads to the support bodies suffering from both tension and pressure, and both outer surfaces incur wear and tear.

U.S. Pat. No. 5,682,937 describes a closure comprising a deformable rolling blind or shade and a drum formed by two parallel shafts, which are situated transversely in the upper position substantially superposed to the axis of the blind or shade. The upper edge of the blind or shaft is joined to the first shaft. The second shaft is joined to the first shaft and free to rotate, when the first shaft is driven by a drive mechanism and is free to rotate, at a slightly different speed than the first shaft. This provides a winding mechanism in which successive layers or turns of the shade or blind do not come into contact to each other avoiding an erratic unwinding of the shade or blind. The patent also describes a shade or blind in which the separation of the successive layers or turns is achieved by having stepped pulleys mounted on each end of the shafts having cheeks of different diameters to selectively form bearings with the ends of the slats of the shade or blind. The separation may also be achieved by the cheeks of the two superimposed shafts forming a bearing with end pieces attached to the slats of the shade or blind and extending at different lengths from the slats. The separation of the slats of the shade or blind may be obtained by rollers of different diameter attached to the ends of the slats, co-operating in reverse with independent tracks having the same diameter borne by the ends of the superimposed shafts. The disadvantages with this winding principle are the need for multiple shafts, and a low winding speed, as the shade or blind has to pass around the several shafts.

SUMMARY OF THE INVENTION

To avoid the disadvantages of the closures of the art as stated herein above, the present invention provides an industrial rollup door comprising a door leaf curtain covering the door opening. The leaf is at least flexible in the rollup direction and may comprise a flexible sheet material, or substantially rigid lamellae or slats, or a combination thereof including sections for windows, etc. The leaf is guided at the edges and can be rolled up in several layers. In most door applications the door is operating vertically, but also horizontal or angled operation are possible.

In order to minimize the noise and wear and facilitate the rapid opening/closing of the door, it is important that the leaf is rolled up on specially designed pair of conical modules and thereby avoids direct contact with the other parts of the door leaf. The object of the present invention is to decrease the noise level and facilitate higher opening and closing speeds and to improve the safe operation of such types of rollup door.

DETAILED DESCRIPTION OF THE INVENTION

Figure 1:
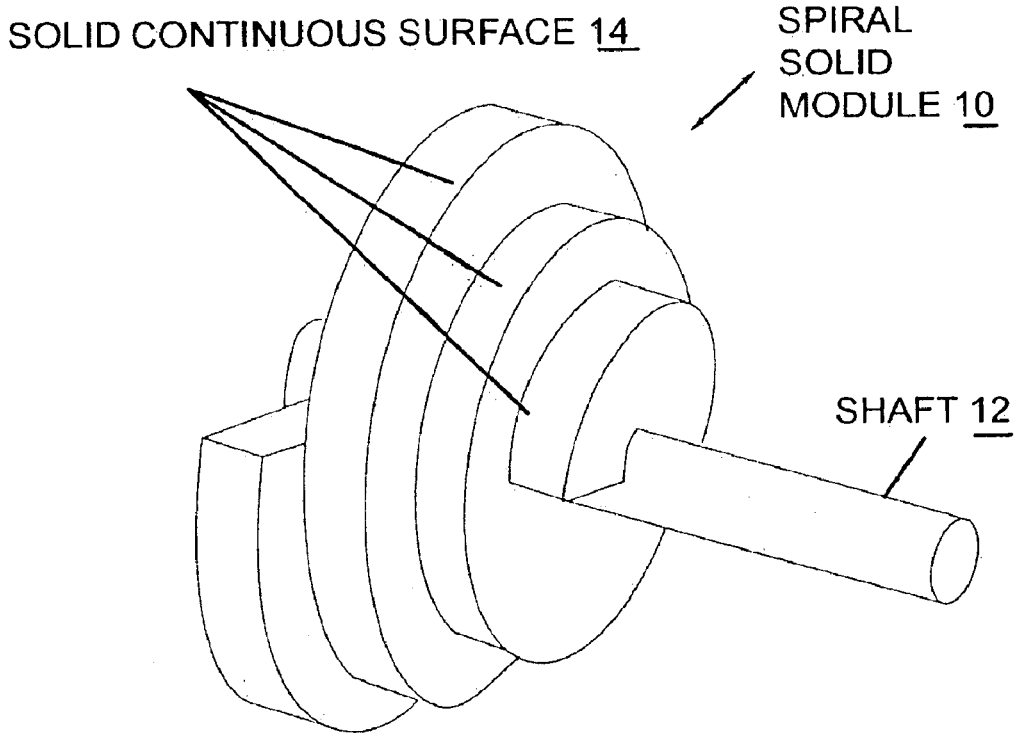
FIG. 1 is a perspective view of the spiral solid module (left side) according to a first embodiment of the present invention.

A first embodiment of the rollup door according to the present invention will now be described with reference to FIGS. 1–4. FIG. 1 is a perspective view of a module 10 mounted on a shaft 12 and used in rolling and unrolling the door. Alternatively, the shaft 12 itself could have the shape of a module (not shown). In the present embodiment, the module 10 has an outer shape of a conical spiral with a solid continuous surface 14. Advantageously, module 10 is successively radially enlarged, and includes smaller and larger parts of increasing diameter. The module 10 will be further described in reference to FIG. 2.

Figure 2:
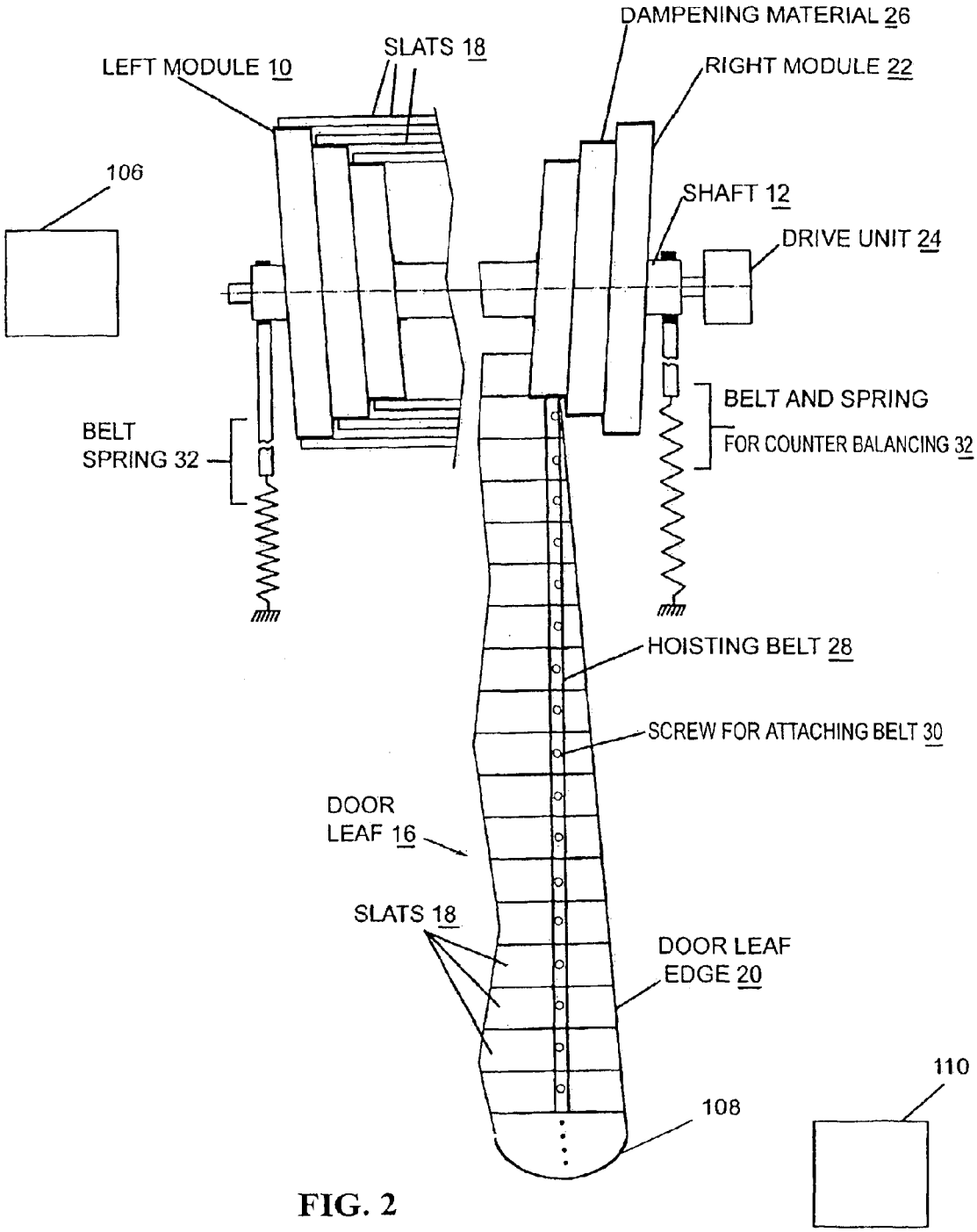
FIG. 2 is an internal view of the open door (to the left of FIG. 2) and the closed door (to the right of FIG. 2)
Figure 2A:
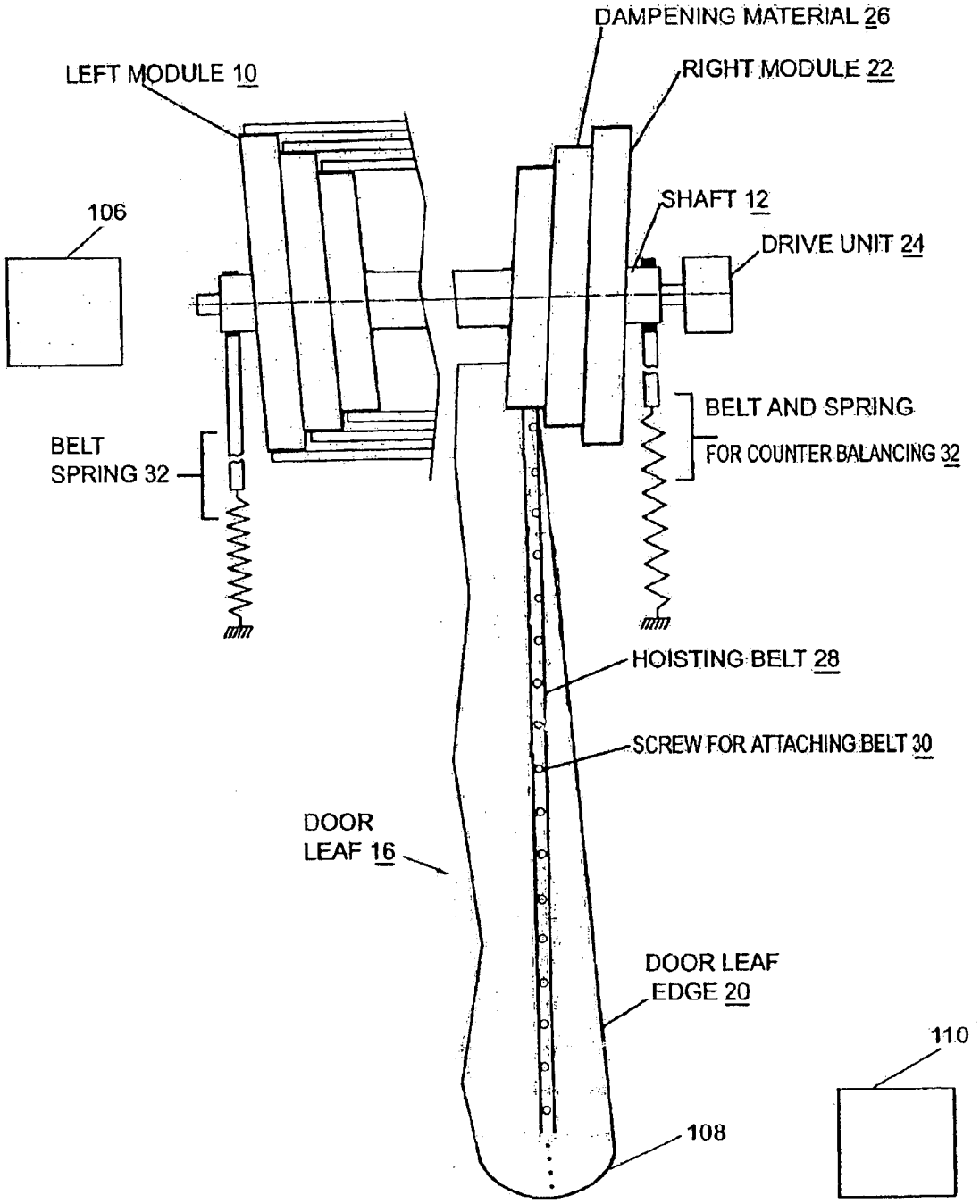
FIG. 2A is an internal view of the door in the closed position (see right portion of FIG. 2A), and in the open position (see left portion of FIG. 2A).

FIG. 2 is an internal view of the door in the closed position (see right portion of FIG. 2), and in the open position (see left portion of FIG. 2). The right portion of FIG. 2 shows a door blade, or door leaf 16, in a closed position covering a door opening. In most door applications the door is operated vertically as shown in FIG. 2, but horizontal or angled operation of the door is also contemplated. The door leaf 16 has a trapezoidal shape of continuously increasing width from top to bottom. However this width increase may also be stepwise, as later shown and described. The door leaf 16 is flexible in at least the rolling direction and may comprise a flexible sheet material such as polyvinyl chloride (PVC), Rolltex® (a product offered by Albany International Corp.) or other kind of rollable door material suitable for the purpose. The door material may also be of laminate, reinforced or film-like construction. The door leaf 16 may further include sections with properties other than those of its main section, such as window sections.

According to the present embodiment shown in FIG. 2, the door leaf 16 comprises a series of connected substantially rigid lamellae, or slats 18, which give the door flexibility in the rolling direction. The slats 18 may be of metal or polymeric composition, or a combination thereof, or of any other material suitable for the purpose, and may further comprise reinforced components (not shown). Note that the slats 18 may be colored or transparent, or may have various surface textures. With the present embodiment, the slats 18 are of continuously increasing width from top to bottom, as FIG. 2 well illustrates. However this width increase may instead be stepwise, as later described in connection with a different embodiment. The door leaf 16 may also include edge portions (not shown) which correspond to the width increase of the door from top to bottom. Finally, note that the door leaf 16 is guided along its edges 20 which extend into vertical channels, as later shown in other figures.

To minimize noise and wear and facilitate the safe and rapid opening/closing of the door shown in FIG. 2, the door leaf 16 is rolled up on a pair of conical modules 10, 22 so that the slats 18 do not to come in contact during rollup or unrolling. Advantageously, the aforementioned winding principle permits rapid door speeds of up to, for example, 3 meters per second. Note further that the modules 10, 22 are connected by a shaft 12 rotated by a drive unit 24, which may be a motor or the like. As FIG. 2 indicates, the modules 10, 22 are situated on respective sides of the shaft 12, and have the same center axes. Importantly, the modules 10, 22 are successive radially enlarged so that on opening and closing of the door, the narrower and wider parts respectively of the door leaf 16 engage the smaller and larger parts respectively of the modules 10, 22. In this regard, the door leaf edges 20 are shaped to fit the continuous spiral contour of the modules 10, 22. Dampening material 26 may be provided on the surface of the modules 10, 22 or directly on the door leaf 16 to reduce noise and wear, increase the grip when winding up, and prevent the slats 18 from sliding.

In FIG. 2, the door leaf 16 is attached to each of the modules 10, 22 via a vertical hoisting belt 28 on each side of the door. However the door leaf 16 may instead be attached directly to the modules 10, 22 without a belt, instead using other means suitable for the purpose. That is, the principal function of the present invention also works for pin jointed lamellae or other conventionally hinged door with slats.

In the embodiment of the present invention illustrated in FIG. 2, the hoisting belt 28 is attached along the entire door leaf 16; that is, belt 28 connects to the end of each slat 18 via screws 30 or other suitable attachment means. Thus, with this embodiment, there is no need for the conventional binge-lock between slats, as the hoisting belt 28 takes up the main vertical forces between each slat 18. Instead, connection between the slats 18 may be of a flexible material to make the closure tight, as later described. Alternatively, the belt 28 may be divided along the edges of the door and overlapping sideways (not shown). Note that the door may include additional features such as belts and springs 32 for counterbalancing shown in FIG. 2, and a tensioning system 106, safety edges 108 or sensors 110.

Figure 3:
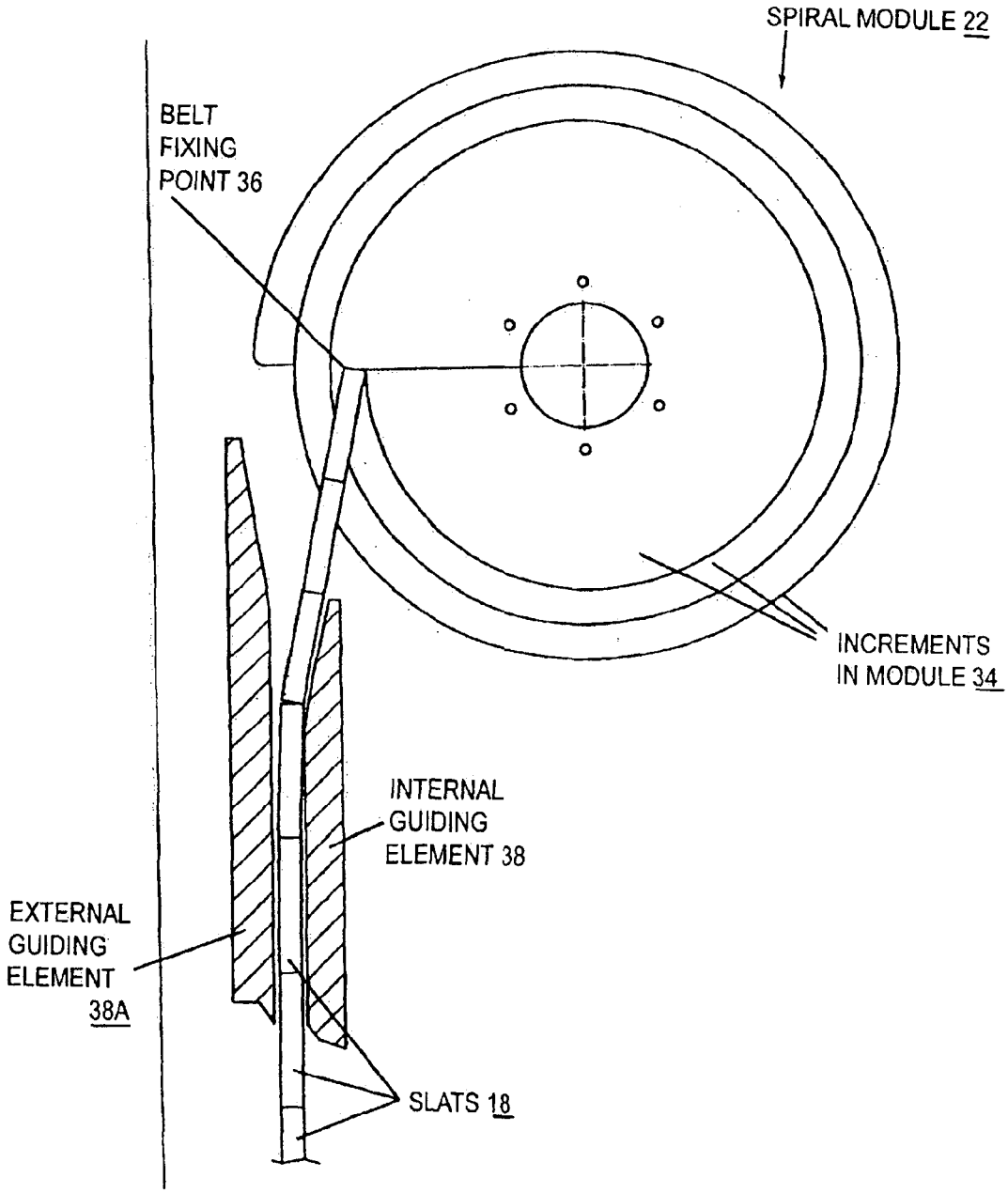
FIG. 3 is a view from inside the door to the right, closed position.
Figure 4:
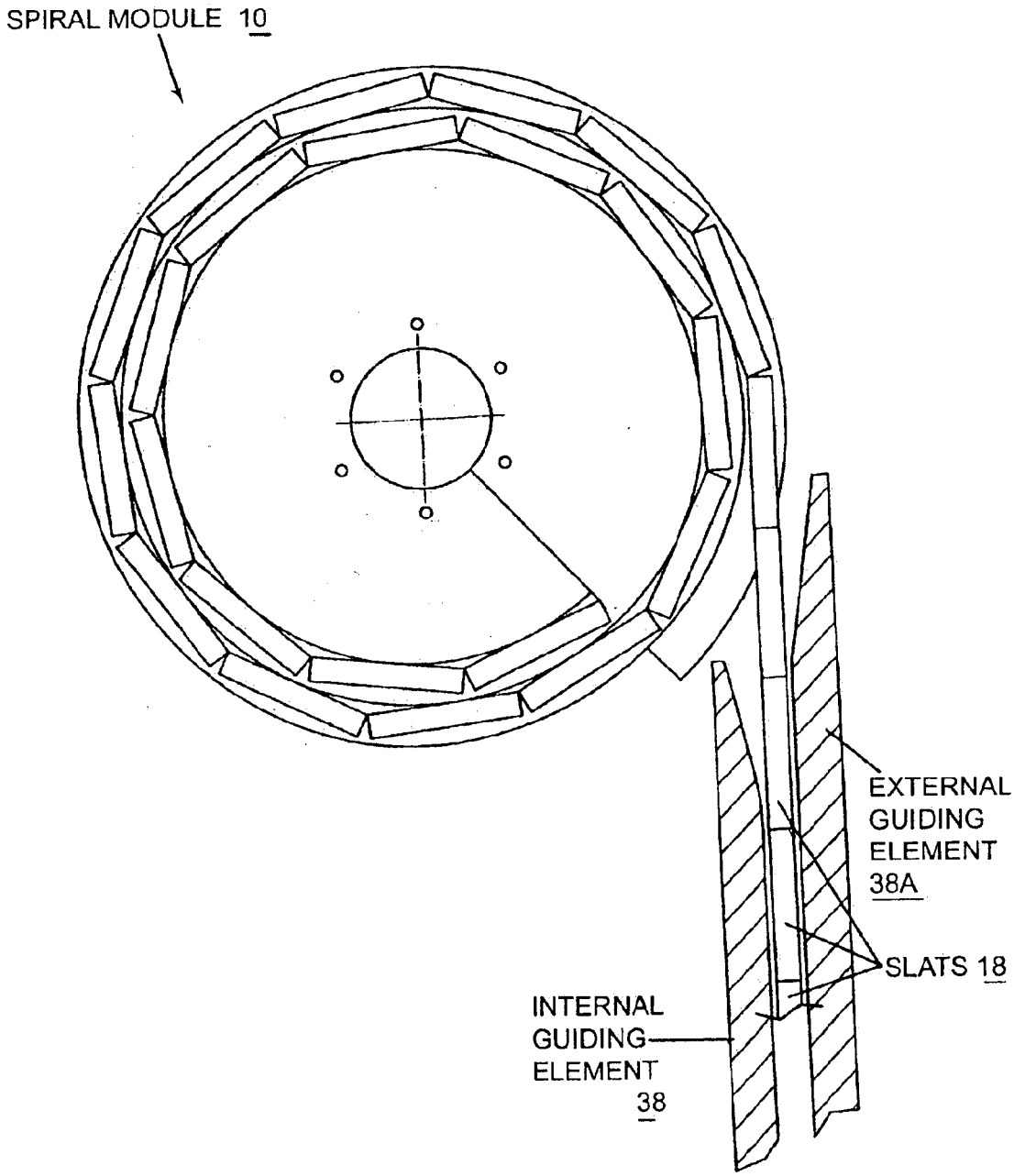
FIG. 4 is a view from inside the door to the left, open approximately two thirds.

FIG. 3 is a view, from inside the door to the right, of the door in the closed position. The stepwise increments 34 of the spiral module 22 are shown. Note that the slats 18 are attached to the module 22 at a fixing point 36 and guided in internal and external vertical guiding elements 38 and 38A respectively. The guides 38, 38A may be enlarged to conceal the non-square shape of the door. Further, the space between the guides 38, 38A may be adapted to the slat caliper and guides 38, 38A may be lined with wear-resistant material (not shown). FIG. 4 is a view, from inside the door to the left, of the door open approximately two thirds. The slats 18 of continuously increasing width are shown wound around the successive radially enlarged module 10 without contacting (overlapping).

Figure 5:
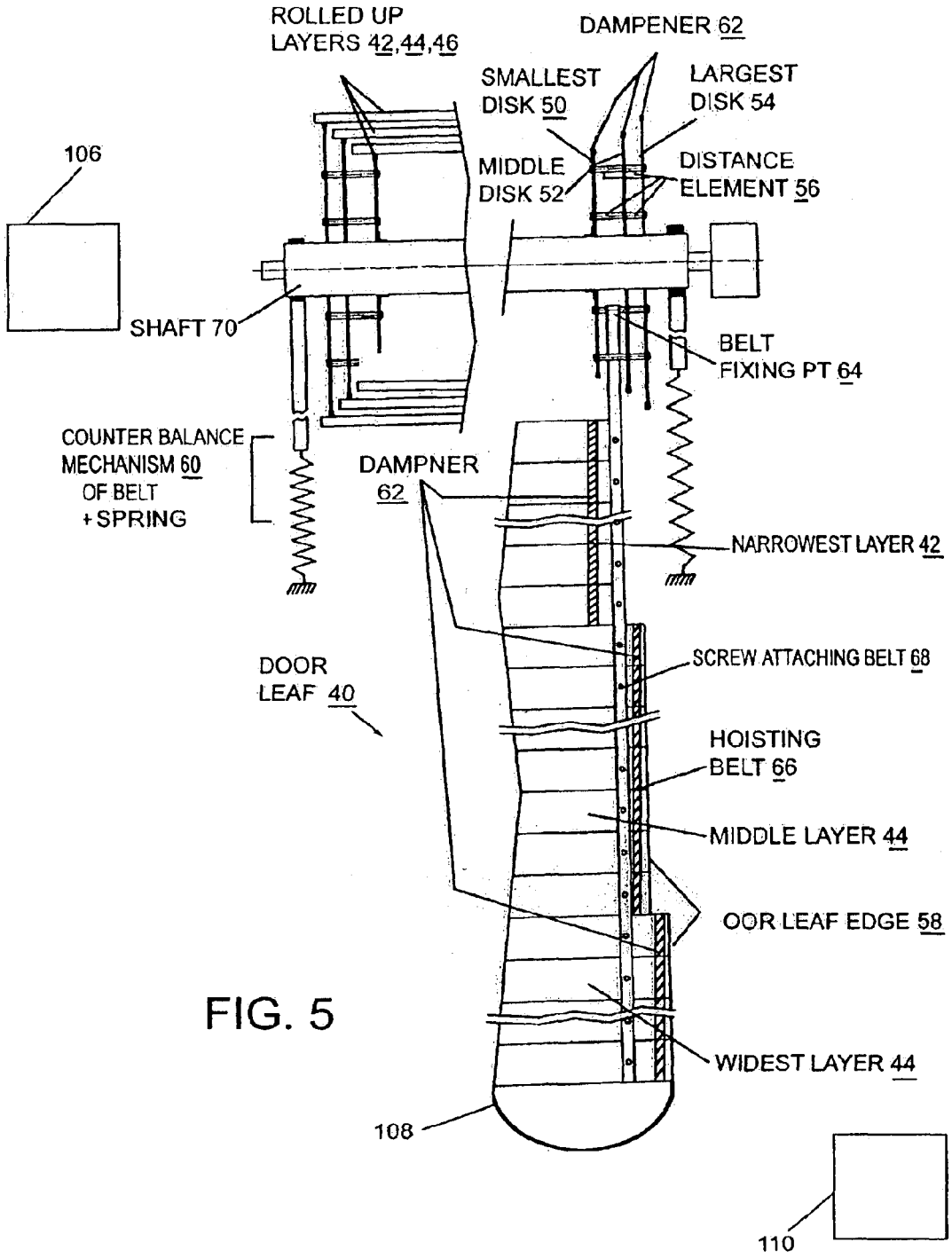
FIG. 5 is an internal view of the open door (to the left of FIG. 5) and the closed door (to the right of FIG. 5) according to a second embodiment.

A second embodiment of the invention is now described with reference to FIGS. 5–7. FIG. 5 is an internal view of the door in the closed position (see right portion of FIG. 5), and in the open position (see left portion of FIG. 5). According to the present embodiment, door leaf 40 comprises layers 42, 44, 46 of stepwise increasing width from top to bottom. Note that each layer comprises slats of equal width. Also with this embodiment, each of the two modules is a package of thin-walled parallel disks. For simplicity, the disk package comprising disks 50, 52, 54 on the right side of the door will be described. Distance elements 56 are provided, for example, to stiffen up the disc package. The distance element 56 between the smallest and middle disks 50, 52 may also serve as a fixing point 64 for the attachment of the hoisting belt 66. In addition, the distance elements 56 also facilitate guiding the door leaf 40.

As the door is raised, each respective layer 42, 44, 46 is rolled up on the respective disks 50, 52, 54 so as to avoid direct contact with the other layers. Advantageously, the disks 50, 52, 54 are successive radially enlarged, so that on opening and closing of the door, the narrower and wider layers 42, 44, 46 respectively engage the smaller and larger disks 50, 52, 54 respectively. In this connection, the door leaf edge 58 is shaped to fit the stepped contour of the disk package.

The other elements of the present embodiment shown in FIG. 5 are similar to those previously detailed with respect to the first embodiment shown in FIG. 2. For example, provided are a shaft 70 connecting the respective left and right side disk packages. Alternatively, the shaft 70 could accommodate an additional disk 114 at its midpoint, used for example to support the first turn of the door leaf 16. Also provided is a counterbalance mechanism 60. Note also that the layers 42, 44, 46 are attached to each of the disk packages at each fixing point 64 via a hoisting belt 66 on each side, and that a respective belt 66 is screw 68 or other means connected to each slat.

Noise reduction members or dampeners 62 are provided tangentially around the circumference of each disk. In the case where a respective disk is made thin, for example, the dampener 62 can be made wide so as to even cover both sides at the edge of the disk. This dampener 62 is mainly dampening noise coming from direct mechanical contact of the various moving parts of the door assembly. Noise reduction members or dampeners 116 may also be directly on the door leaf.

Figure 6:
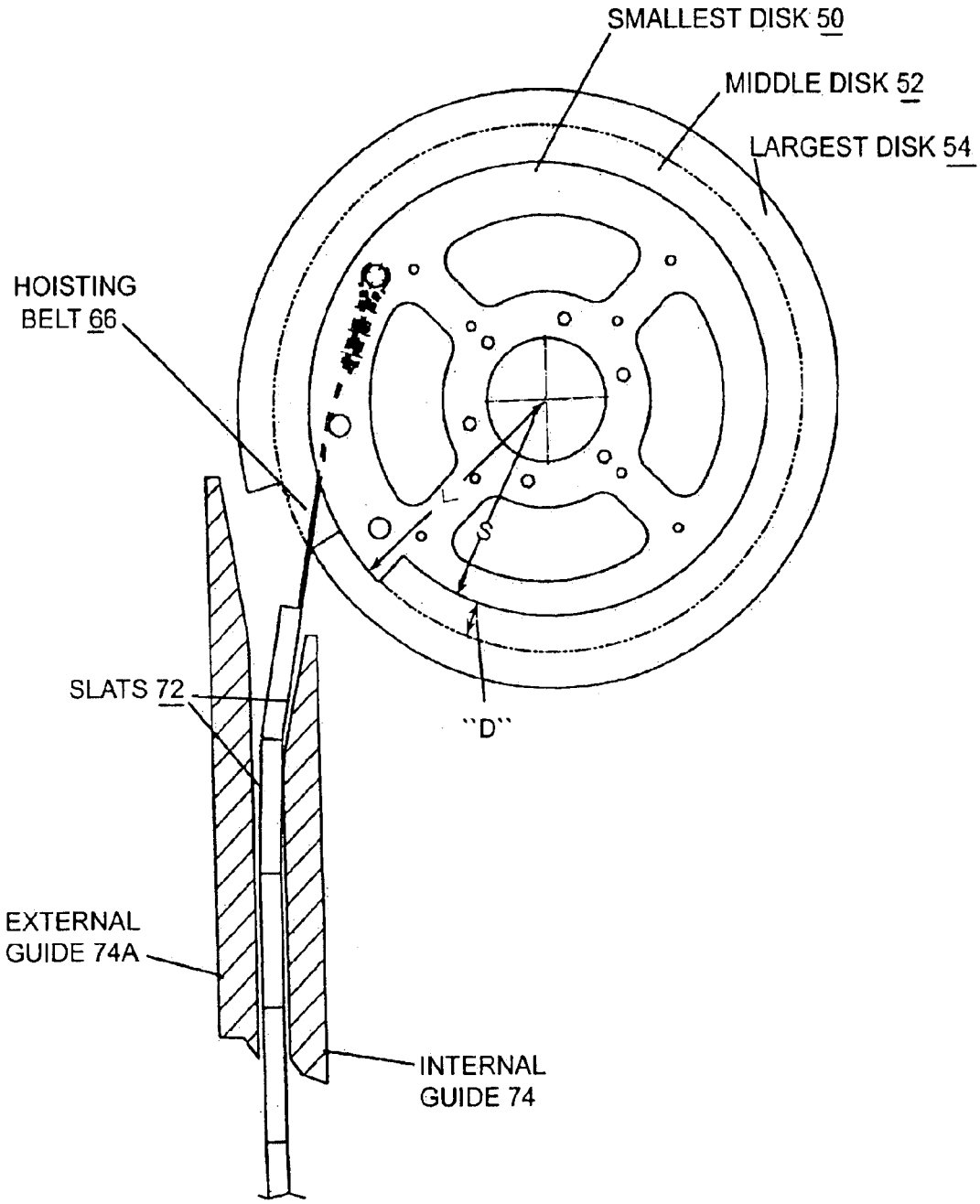
FIG. 6 is a view from inside the door to the right, closed position.

FIG. 6 is a view, from inside the door to the right, of the door in the closed position. According to the winding principle of the present embodiment, the top slat is fixed to the disk package via the hoisting belt 66 as previously described, and the slats 72 guided in internal and external guides 74, 74A are rolled over the disks 50, 52, 54 without sliding. As a result, wear on the slats and disks, along with noise, sliding/friction, and energy losses, are all low. Also, for each disk, the difference between its smallest radius "S" and its largest radius "L" is a distance "D", which is equal to the slat thickness plus a distance for operating space. Generally, the number of steps, layers and disks and their respective dimensions are determined according to the height of the door leaf. For example, a door leaf of 3 meters height having 1 step and thus 2 layers, will roll onto 2 disks each having a circumference of approximately 1.5 meters.

Figure 7:
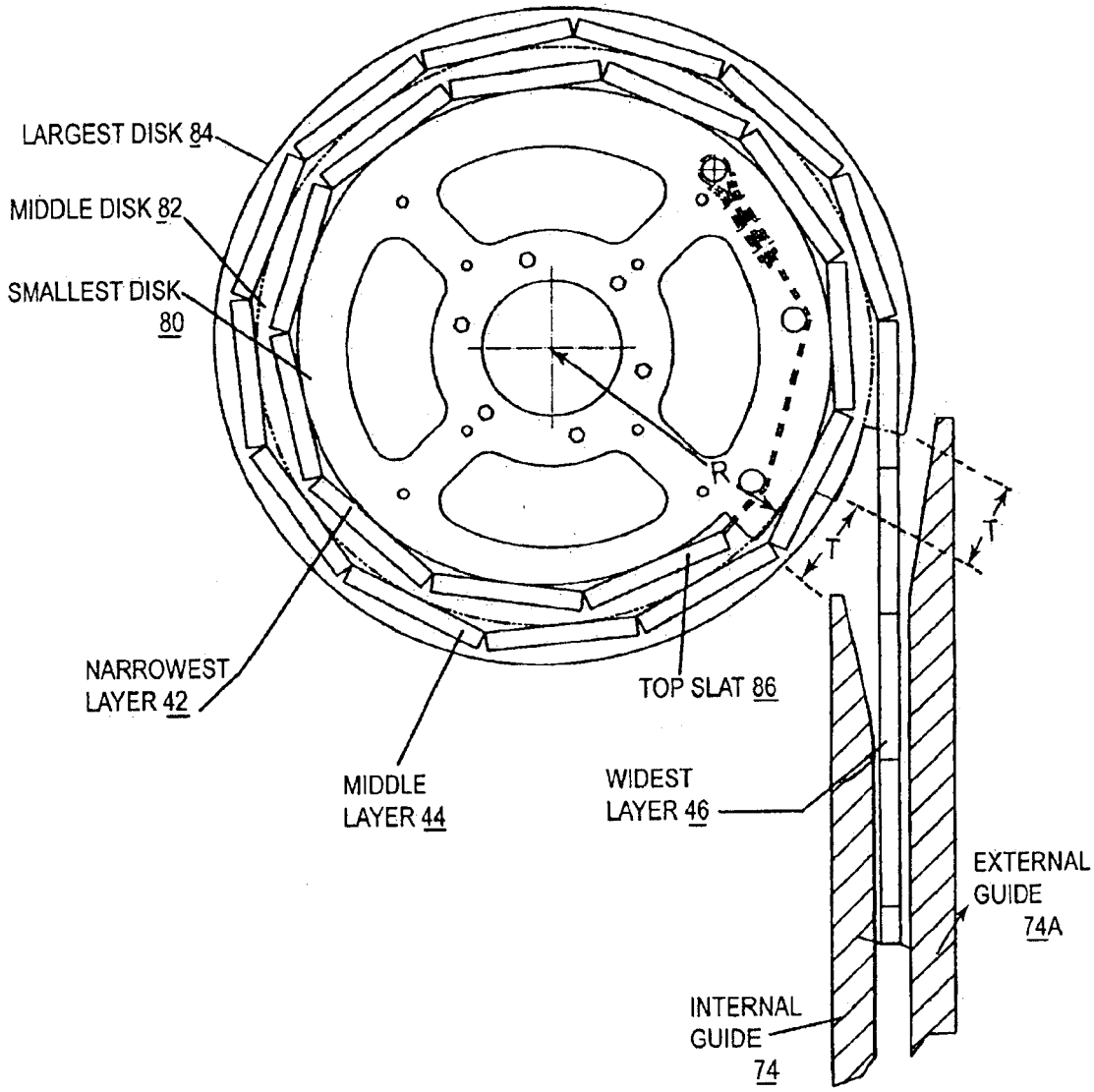
FIG. 7 is a view from inside the door to the left, open approximately two thirds.

FIG. 7 is a view, from inside the door to the left, of the door open approximately two thirds, so that the narrowest and middle layers 42, 44 are wound onto the smallest and middle disks 80, 82 without contacting (overlapping). Note that the largest radius "R" of any disk is the same as the smallest radius "R" of the next larger disk in the transfer section "T". (The transfer section is where a slat is partly rolled up on one disk and partly on the next disk). As a result, the slats are wound up in a continuously increasing radius. This gives a desirably even power/torque and smooth transfer between the disks 80, 82, 84. Also, by fixing the top slat 86 to the smallest disk 80 via the hoisting belt 66, safe operation of the door is ensured. This is because the kinetic energy of the door leaf 40 in either the open or closed position is favorably low with respect to the forces and angles in the upper portions of internal and external guides 74, 74A. Further, since only tension forces are affecting the hoisting belt 66, the large disk radius does not cause bending forces in the door leaf 40, and minimal friction occurs.

Figure 8:
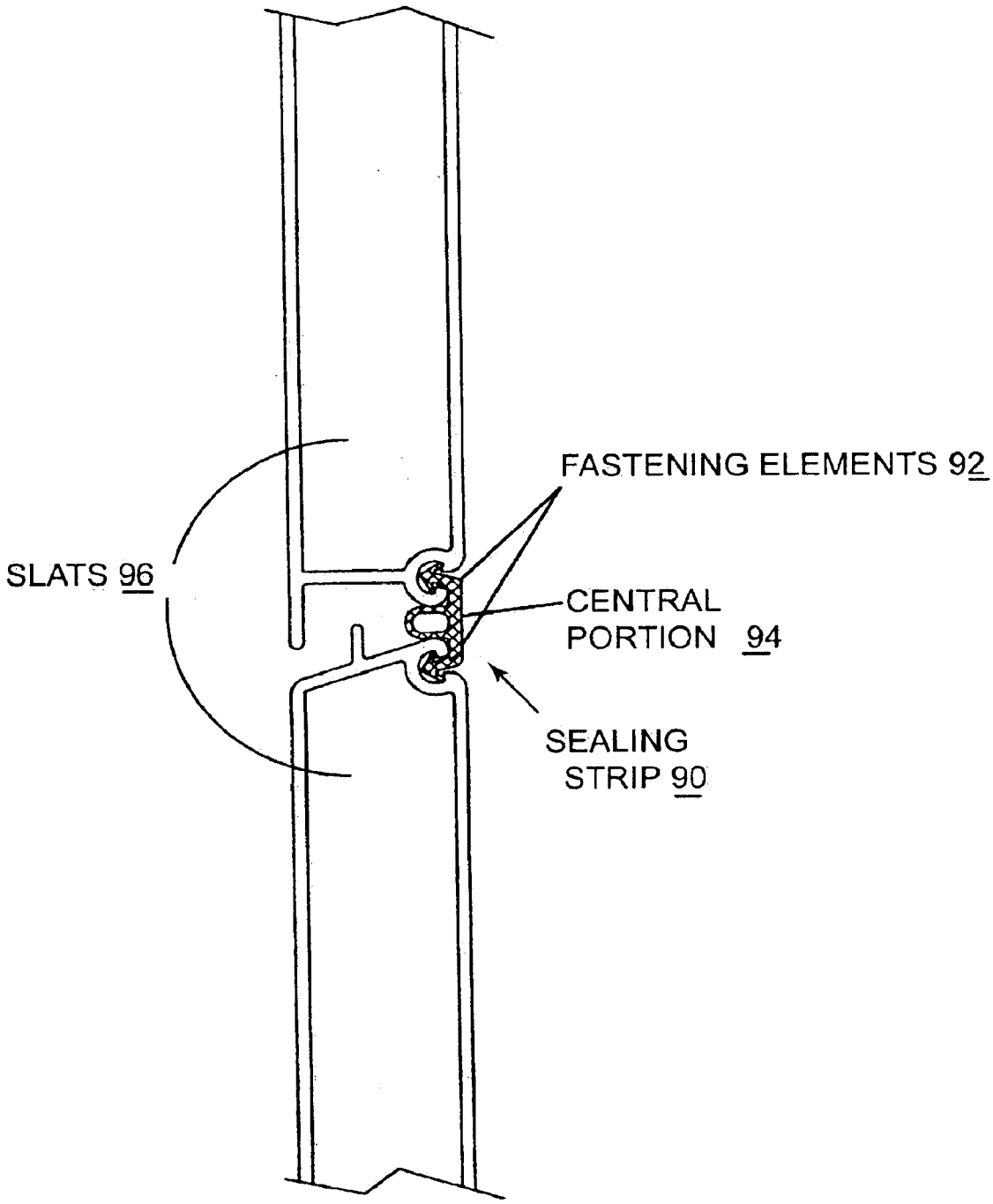
FIG. 8 is a cross section of two adjacent slats and a sealing strip.

FIG. 8 is a cross section of a sealing strip 90 of flexible or rigid material connecting two adjacent slats 96 to make the closure therebetween tight and weather resistant. The strip 90 is easily inserted between the slats 96 from the side or pressed in from the front of the door, and also includes fastening elements 92. The strip 90 also includes a central portion 94 for dampening noise between swinging slats 96 during the opening and closing of the door.

Figure 9A:
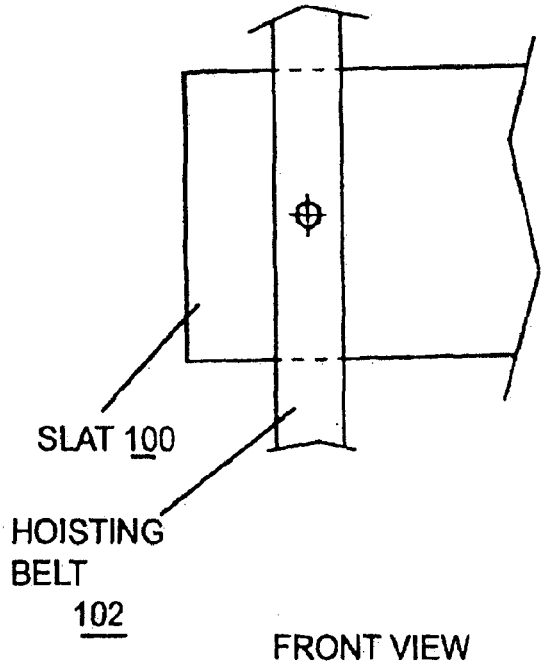
FIG. 9A is a front view of a slat with belt attached.
Figure 9C:
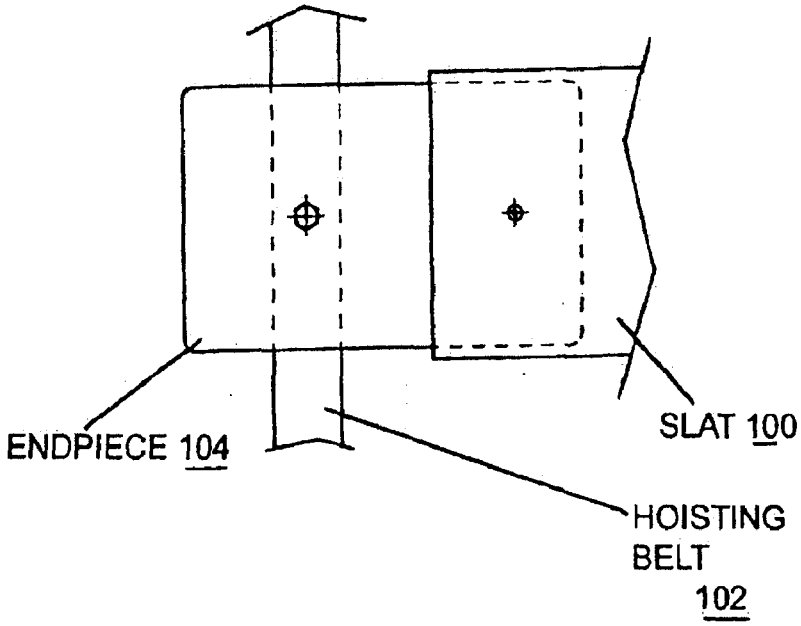
FIG. 9C is a rear view of a slat with inserted end piece, and a belt attached to the end piece.
Figure 9D:
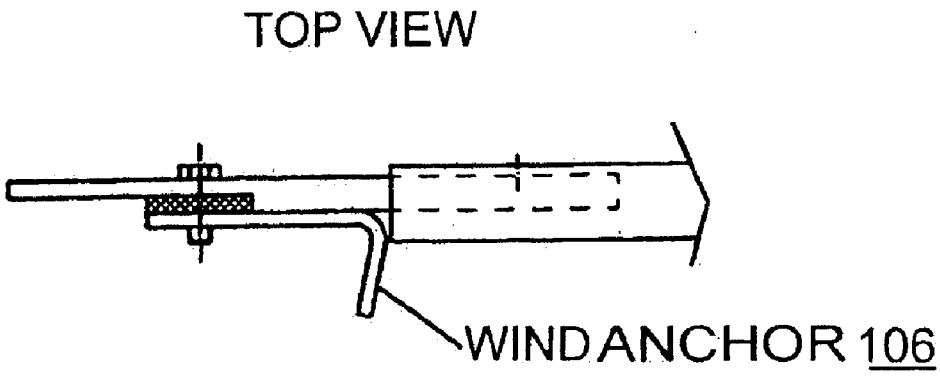
FIG. 9D is a view of FIG. 9C from below further including a wind anchor.
Figure 9B:
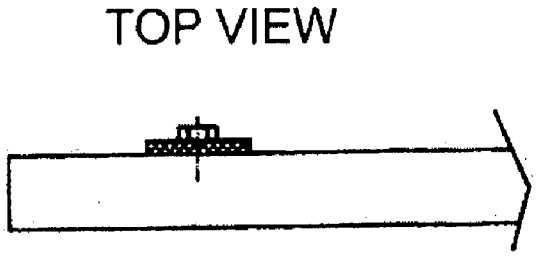
FIG. 9B is a view of FIG. 9A from below.

FIGS. 9A and 9B show a typical slat 100 connected directly to the hoisting belt 102. FIGS. 9C and 9D show an alternative embodiment wherein a respective slat 100 includes an endpiece 104 inserted therein. The endpiece 104 is connected to the hoisting belt 102. In this way, the door may comprise slats of equal width but having respective endpieces 104 of increasing width from top to bottom of the door. Note that the endpiece 104 is easily maintained or replaced from the front or side of the door, and may further include a wind resistant hook, or wind anchor 106 to assist in guiding the slats 100.

As understood from the forgoing description, modifications to the industrial rollup door would be obvious to those of ordinary skill in the art, but would not bring the invention so modified beyond the scope of the appended claims.

What is claimed is:

1. A rollup door comprising:

a door leaf of increasing width from top to bottom, having a narrower part on the top and a wider part on the bottom, the door leaf having flexibility in the rolling direction;

channels for guiding the door;

two modules for rolling and unrolling the door leaf so that a number of leaf layers do not come in contact;

the door having a single rotatable shaft on which the modules are situated and have the same center axes and are successive radially enlarged so that on opening and closing of the door, the narrower and wider parts of the leaf engage the smaller and larger parts respectively of the modules.

2. A rollup door according to claim 1 wherein the rotatable shaft connects the modules.

3. A rollup door comprising:

a door leaf of increasing width from top to bottom, having a narrower part on the top and a wider part on the bottom, the door leaf having flexibility in the rolling direction;

channels for guiding the door;

two modules for rolling and unrolling the door leaf so that a number of leaf layers do not come in contact;

the modules are situated on each side of the door, have the same center axes and are successive radially enlarged so that on opening and closing of the door, the narrower and wider parts of the leaf engage the smaller and larger parts respectively of the modules wherein each module has the outer shape of a continuous conical spiral.

4. A rollup door according to claim 1 wherein each module is a package of parallel disks.

5. A rollup door according to claim 1 having a dampener on the surface of the modules or directly on the door leaf.

6. A rollup door comprising:

a door leaf of increasing width from top to bottom, having a narrower part on the top and a wider part on the bottom, the door leaf having flexibility in the rolling direction;

channels for guiding the door;

two modules for rolling and unrolling the door leaf so that a number of leaf layers do not come in contact;

the modules are situated on each side of the door, have the same center axes and are successive radially enlarged so that on opening and closing of the door, the narrower and wider parts of the leaf engage the smaller and larger parts respectively of the modules wherein each module is a package of parallel disks; and wherein the largest radius in a disk is the same as the smallest radius in the next larger disk.

7. A rollup door according to claim 1 wherein the modules have a solid continuous surface.

8. A rollup door according to claim 1 wherein the leaf is attached directly to the modules.

9. A rollup door comprising:

a door leaf of increasing width from top to bottom, having a narrower part on the top and a wider part on the bottom, the door leaf having flexibility in the rolling direction;

channels for guiding the door;

two modules for rolling and unrolling the door leaf so that a number of leaf layers do not come in contact;

the modules are situated on each side of the door, have the same center axes and are successive radially enlarged so that on opening and closing of the door, the narrower and wider parts of the leaf engage the smaller and larger parts respectively of the modules wherein the leaf is indirectly attached to the module via a hoisting belt.

10. A rollup door according to claim 9 wherein the hoisting belt is attached from top to bottom of the door leaf.

11. A rollup door according to claim 2 wherein the shaft carries the initial turn of the door leaf and the module carries subsequent turns of said leaf.

12. A rollup door comprising:

a door leaf of increasing width from top to bottom, having a narrower part on the top and a wider part on the bottom, the door leaf having flexibility in the rolling direction;

channels for guiding the door;

two modules for rolling and unrolling the door leaf so that a number of leaf layers do not come in contact;

the modules are situated on each side of the door, have the same center axes and are successive radially enlarged so that on opening and closing of the door, the narrower and wider parts of the leaf engage the smaller and larger parts respectively of the modules wherein a door leaf edge is shaped to continuously fit a spiral contour of the module.

13. A rollup door according to claim 1 wherein a door leaf edge is stepped to fit the contour of the disk package.

14. A rollup door according to claim 4 having a door leaf with one step and a package of two disks.

15. A rollup door according to claim 4 having a door leaf with two steps and a package of three disks.

16. A rollup door according to claim 4 wherein the number of door leaf steps and the number and dimensions of disks are proportional to the height of the door.

17. A rollup door according to claim 1 wherein the door leaf is a flexible sheet material.

18. A rollup door according to claim 17 wherein the material is of laminate, reinforced or film construction.

19. A rollup door according to claim 1 wherein the door leaf is a series of connected substantially rigid slats giving a flexibility in the rolling direction.

20. A rollup door according to claim 19 wherein the slats comprise metallic, polymeric or reinforced materials, or a combination thereof.

21. A rollup door according to claim 19 wherein the slats have a surface texture.

22. A rollup door according to claim 1 wherein the door leaf contains at least one section with properties other than a main part of the leaf.

23. A rollup door according to claim 22 wherein the section is a window.

24. A rollup door according to claim 1 above wherein the door leaf has edge portions which correspond to the width increase of the door from top to bottom.

25. A rollup door according to claim 19 wherein the slats have end pieces inserted therein.

26. A rollup door comprising:

a door leaf of increasing width from top to bottom, having a narrower part on the top and a wider part on the bottom, the door leaf having flexibility in the rolling direction;

channels for guiding the door;

two modules for rolling and unrolling the door leaf so that a number of leaf layers do not come in contact;

the modules are situated on each side of the door, have the same center axes and are successive radially enlarged so that on opening and closing of the door, the narrower and wider parts of the leaf engage the smaller and larger parts respectively of the modules;

wherein the door leaf is a series of connected substantially rigid slats giving a flexibility in the rolling direction;

wherein the slats have end pieces inserted therein and wherein the end pieces are attached to a hoisting belt.

27. A rollup door according to claim 25 wherein the end pieces include a wind anchor.

28. A rollup door according to claim 19 wherein a sealing element is located between the slats.

29. A rollup door according to claim 28 wherein the sealing element comprises mechanical joints, or glue.

30. A rollup door according to claim 28 where the sealing element also serves as a dampener between the slats.

31. A rollup door according to claim 28 wherein the sealing element is inserted between slats from a side of the door.

32. A rollup door according to claim 28 wherein the sealing element is inserted from an inner rolling side of the door.

33. A rollup door according to claim 1 wherein damaged elements are replaceable from an inner rolling side of the door while the door is in a substantially closed position.

34. A rollup door according to claim 19, wherein the slats have end pieces inserted therein and the end pieces are attached to a hoisting belt;

wherein upon a crash, damaged slats are replaceable from an inner rolling side of the door while the hoisting belt is in position.

35. A rollup door according to claim 1 and further including at least one of a safety edge, sensors, tensioning system, and weight balancing systems.

36. A method of assembling an overhead door comprising the steps of:

providing a door leaf of increasing width from top to bottom, the door leaf having flexibility in the rolling direction;

providing channels for guiding the door; and providing two conical modules for rolling and unrolling the door leaf there around so as to be in contact therewith and so that a number of leaf layers do not come in contact, the modules are situated on each side of the door, have the same center axes and are successive radially enlarged so that on opening and closing of the door, the narrower and wider parts of the leaf engage the smaller and larger parts respectively of the modules.

* * * * *